US007677472B2

(12) United States Patent
Hessler

(10) Patent No.: US 7,677,472 B2
(45) Date of Patent: Mar. 16, 2010

(54) DRILLED AND INTEGRATED SECONDARY FUEL NOZZLE AND MANUFACTURING METHOD

(75) Inventor: William Kirk Hessler, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1033 days.

(21) Appl. No.: 11/296,219

(22) Filed: Dec. 8, 2005

(65) Prior Publication Data

US 2007/0131796 A1 Jun. 14, 2007

(51) Int. Cl.

| | |
|---|---|
| ***B05B 7/06*** | (2006.01) |
| ***B64D 33/04*** | (2006.01) |
| ***A62C 5/00*** | (2006.01) |
| ***F02C 1/00*** | (2006.01) |
| ***F02C 3/00*** | (2006.01) |

(52) U.S. Cl. ..... 239/424; 239/127.1; 239/398; 60/746; 60/740; 60/742

(58) Field of Classification Search ..... 239/424, 239/420, 423–425.5, 416.5, 417.3, 419, 403–406, 239/600, 132.3, 397.5, 128, 132, 13, 533, 239/401; 60/39.094, 39.74, 737, 748, 742, 60/740, 733, 732, 746, 776; 431/354, 8, 431/9, 10, 285; 137/469, 541

See application file for complete search history.

(56) References Cited

U.S. PATENT DOCUMENTS

| | | | | |
|---|---|---|---|---|
| 4,154,056 | A * | 5/1979 | Emory | 60/796 |
| 5,199,265 | A * | 4/1993 | Borkowicz | 60/737 |
| 5,259,184 | A * | 11/1993 | Borkowicz et al. | 60/39.55 |
| 5,408,830 | A * | 4/1995 | Lovett | 60/737 |
| 5,491,970 | A * | 2/1996 | Davis et al. | 60/776 |
| 5,873,237 | A * | 2/1999 | Medla et al. | 60/800 |
| 6,256,995 | B1 * | 7/2001 | Sampath et al. | 60/740 |
| 6,282,904 | B1 * | 9/2001 | Kraft et al. | 60/739 |
| 6,446,439 | B1 * | 9/2002 | Kraft et al. | 60/739 |
| 2004/0006989 | A1 * | 1/2004 | Stuttaford et al. | 60/776 |
| 2004/0177615 | A1 * | 9/2004 | Martling | 60/740 |
| 2004/0265136 | A1 | 12/2004 | Martling et al. | |

OTHER PUBLICATIONS

Chinese First Office Action (English Translation) for Application No. 200610063954.2, dated Oct. 9, 2009.

* cited by examiner

*Primary Examiner*—Dinh Q Nguyen
*Assistant Examiner*—Justin Jonaitis
(74) *Attorney, Agent, or Firm*—Nixon & Vanderhye PC

(57) ABSTRACT

A secondary fuel nozzle is formed by brazing and welding a central core, a cylindrical body, and a unitary secondary fuel nozzle portion. The central core has a central bore for receiving a liquid fuel cartridge, and at least two passages concentric with the central bore. The secondary fuel nozzle portion includes a base flange and a main shaft having a central bore for aligning with the central bore of the core and for receiving the liquid fuel cartridge, and a plurality of peripheral bores disposed at spaced locations about the central bore for flow communication with the concentric passages of the core. The core is brazed to the base flange and the cylindrical body is disposed around the core and welded to the base flange to define a one-piece secondary fuel nozzle assembly.

9 Claims, 5 Drawing Sheets

DRILLED AND INTEGRATED SECONDARY FUEL NOZZLE AND MANUFACTURING METHOD

BACKGROUND OF THE INVENTION

Conventional secondary fuel nozzle constructions are multi-weld, multi-part complex assemblies. As a consequence they include multiple seals and multiple welds that are potential failure locations and leak paths.

BRIEF DESCRIPTION OF THE INVENTION

The invention provides an integrated one-piece secondary fuel nozzle that is drilled to define secondary, pilot and tertiary passages in appropriate locations. The proposed integrated one-piece structure uses far fewer parts than the conventional assembly, and the unique design has fewer weld areas so as to be easier to manufacture and less expensive and easier to construct.

Thus, the invention may be embodied in a secondary fuel nozzle assembly comprising: a core portion having proximal and distal longitudinal ends, a central bore for receiving a liquid fuel cartridge, and at least two passages concentric with said central bore and extending along at least a part of the length thereof to said distal end; and a unitary secondary fuel nozzle portion, the secondary fuel nozzle portion including a base flange, and a main shaft having a central bore for aligning with the central bore of the core portion and for receiving the liquid fuel cartridge, and a plurality of peripheral bores disposed at spaced locations about the central bore for flow communication with at least one of said concentric passages of the core portion, wherein said core portion and said one piece secondary fuel nozzle portion are integrated into a one-piece assembly by being at least one of brazed and welded together.

The invention may also be embodied in a method of manufacturing a secondary fuel nozzle, comprising: providing a core portion having proximal and distal longitudinal ends, a central bore for receiving a liquid fuel cartridge, and at least two passages concentric with said central bore and extending along at least a part of the length thereof to said distal end; providing a unitary secondary fuel nozzle portion including a base flange, and a main shaft having a central bore for aligning with the central bore of the core and for receiving the liquid fuel cartridge; gun drilling a plurality of peripheral bores at spaced locations about the central bore; and at least one of brazing and welding said core portion to said base flange of said unitary secondary fuel nozzle portion, whereby the core portion and nozzle portion are integrated to define a one-piece secondary fuel nozzle assembly.

DETAILED DESCRIPTION OF THE INVENTION

Figure 1:
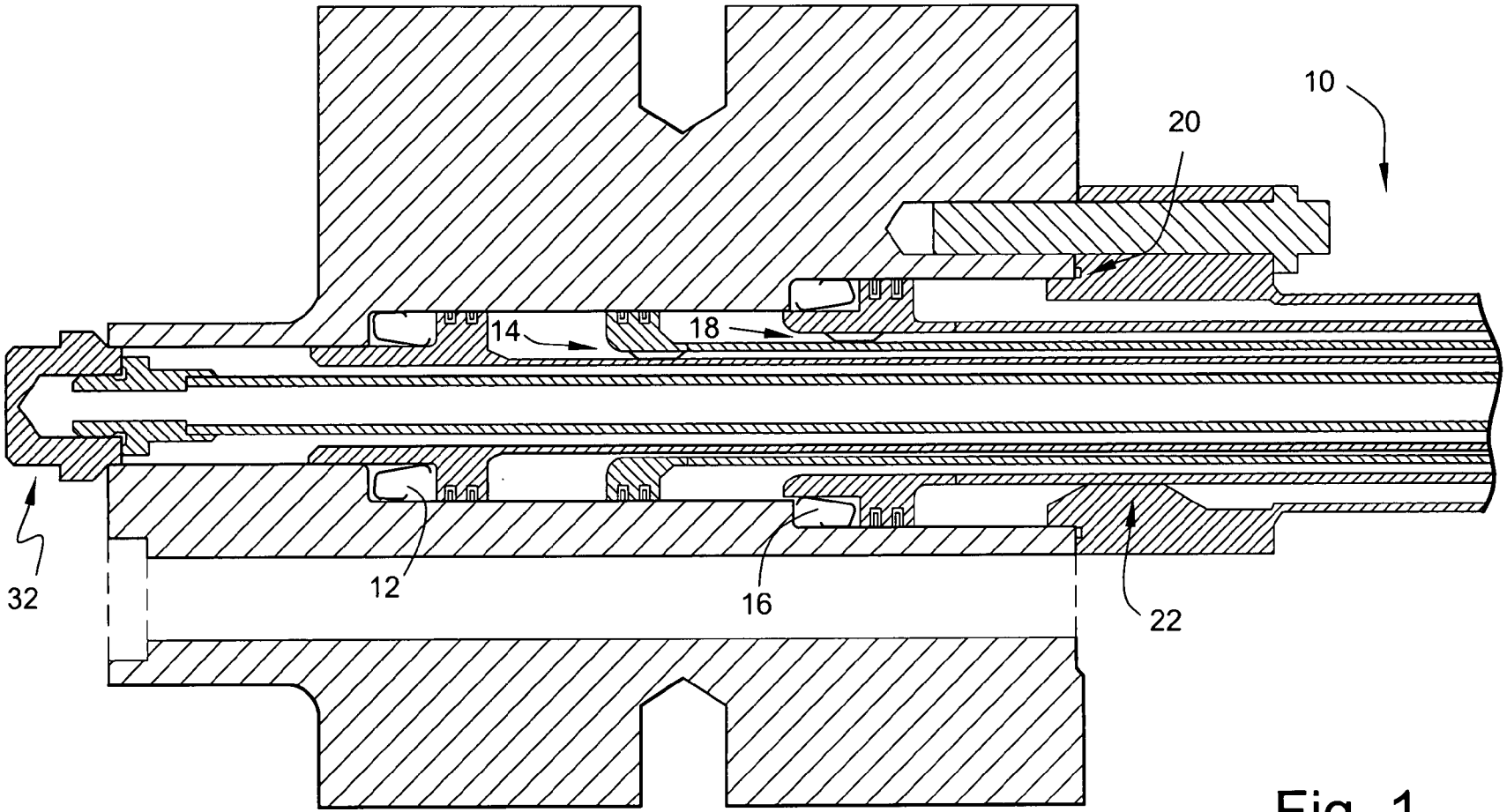
Fig. 1 (PRIOR ART)
FIGS. 1-2 together schematically illustrate a conventional secondary fuel nozzle.
Figure 2:
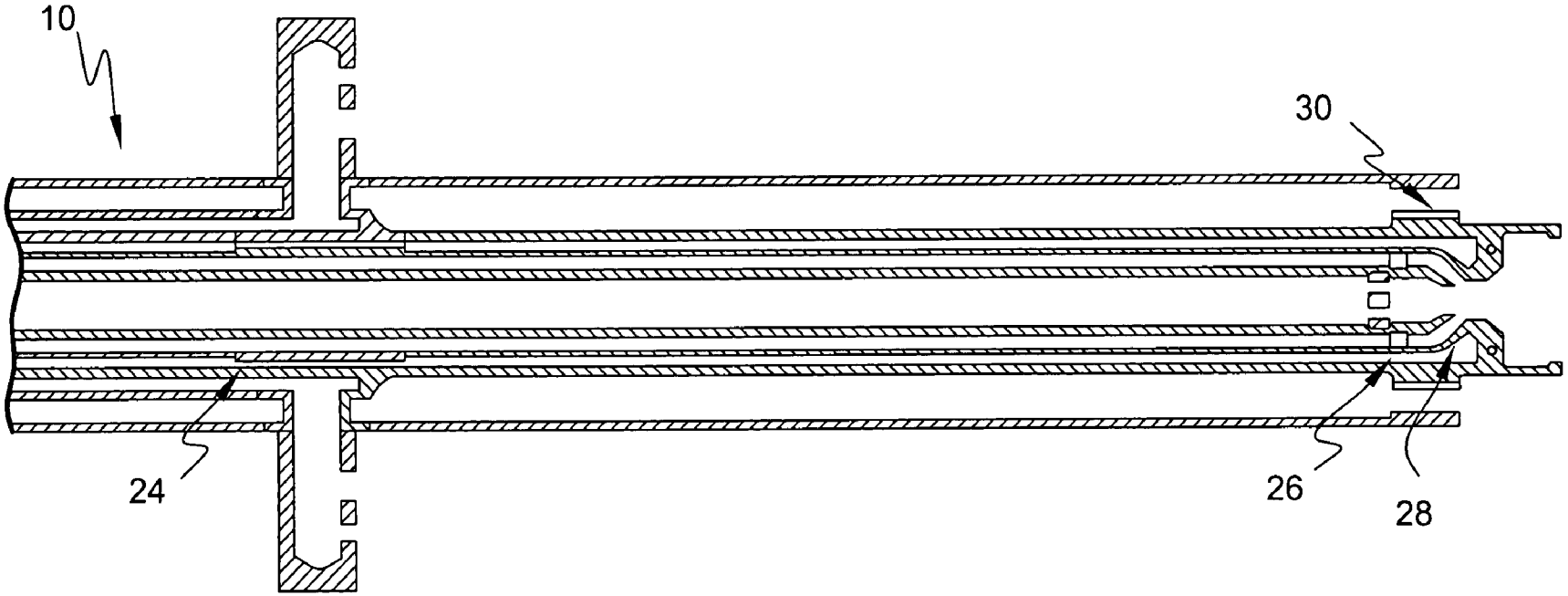
Fig. 2 (PRIOR ART)

FIGS. 1 and 2 together schematically illustrate a conventional secondary fuel nozzle 10. As depicted therein, the conventional nozzle includes, starting from the proximal end, a water lip seal cavity 12, a water passage concentricity feature 14, a diffusion lip seal cavity 16, a pilot passage concentricity feature 18, a body to sleeve fuel cavity 20, a secondary passage concentricity feature 22, a water passage support at the manifold 24, and an oil tip swirler shroud to water tip junction 26. Also illustrated are the oil tip to water tip gap 28 and the tertiary tip to secondary tip gap 30. Centrally of the secondary fuel nozzle is an oil cartridge 32.

The water lip seal cavity 12 and the diffusion lip seal cavity 16 each have two piston ring seals and one lip seal. The water passage concentricity feature 14 also has two piston ring seals and the body to sleeve fuel cavity 20 has one ring seal. Thus, there are a total of nine seals in the depicted conventional design that are potential failure locations and gas leak paths. The lip seals are gold plated, very expensive seals. The other 6 smaller piston ring type seals are also expensive seals. Additionally, the structure is difficult to manufacture and assemble. In addition to the multiple seals, in the conventional design there are a minimum of 12 circular welds required to attach pipes, plus 6 fuel pegs welded to the base manifold. These are all potential failure locations and leak paths.

Figure 3:
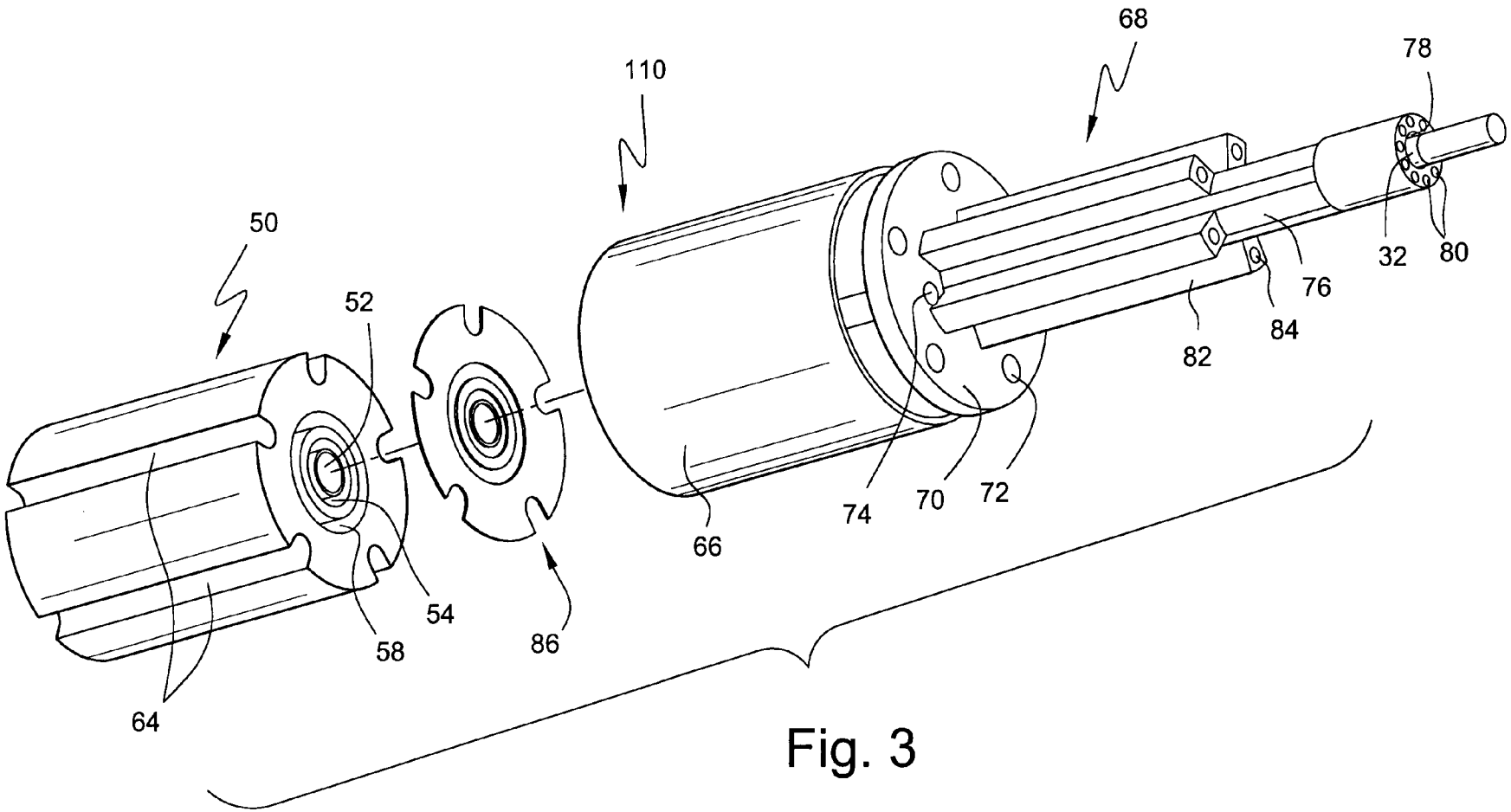
FIG. 3 is an exploded perspective view of a secondary fuel nozzle assembly according to an example embodiment of the invention.
Figure 4:
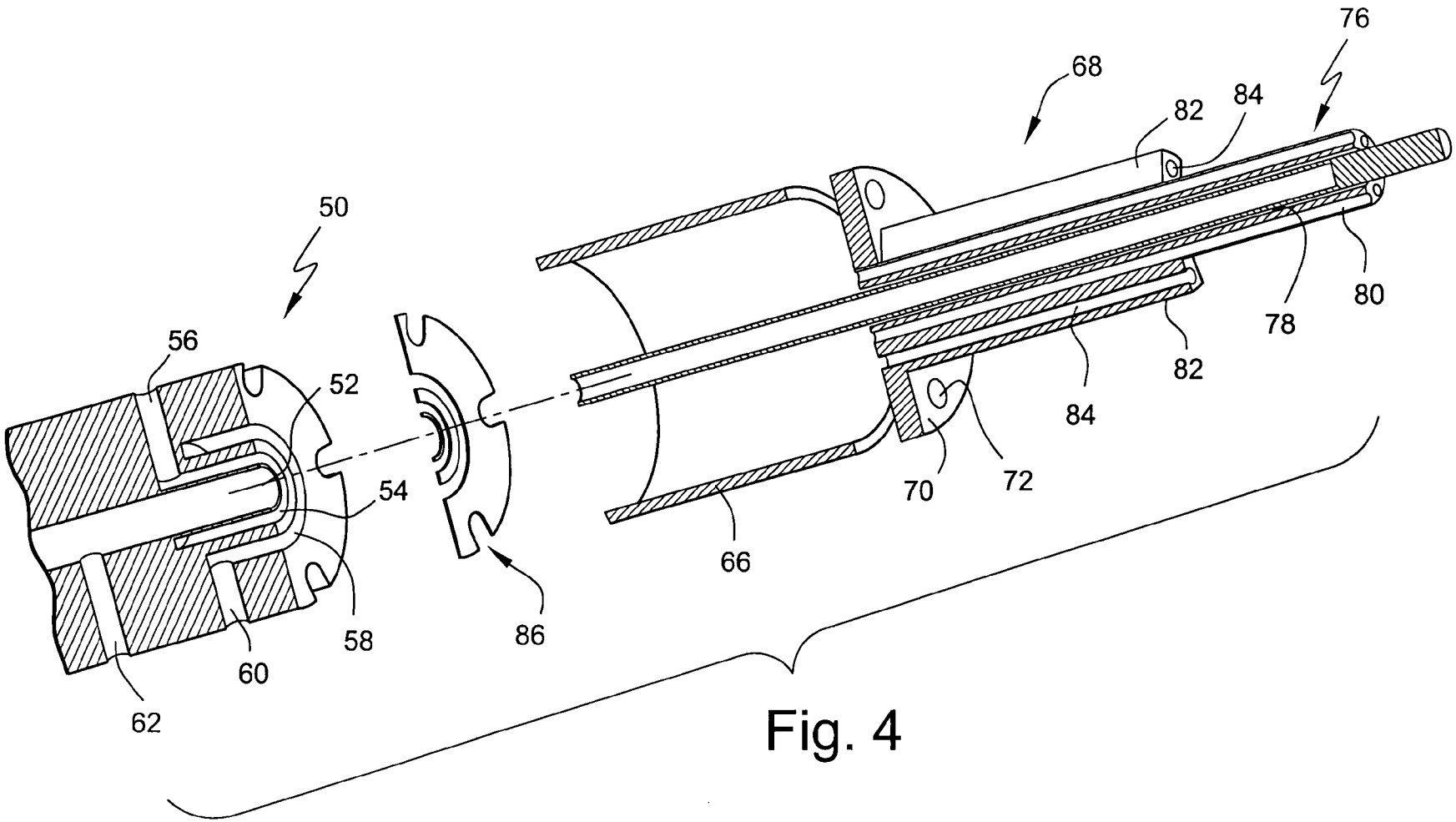
FIG. 4 is an exploded partly cross-sectional view of the assembly illustrated in FIG. 3 to reveal interior detail.
Figure 5:
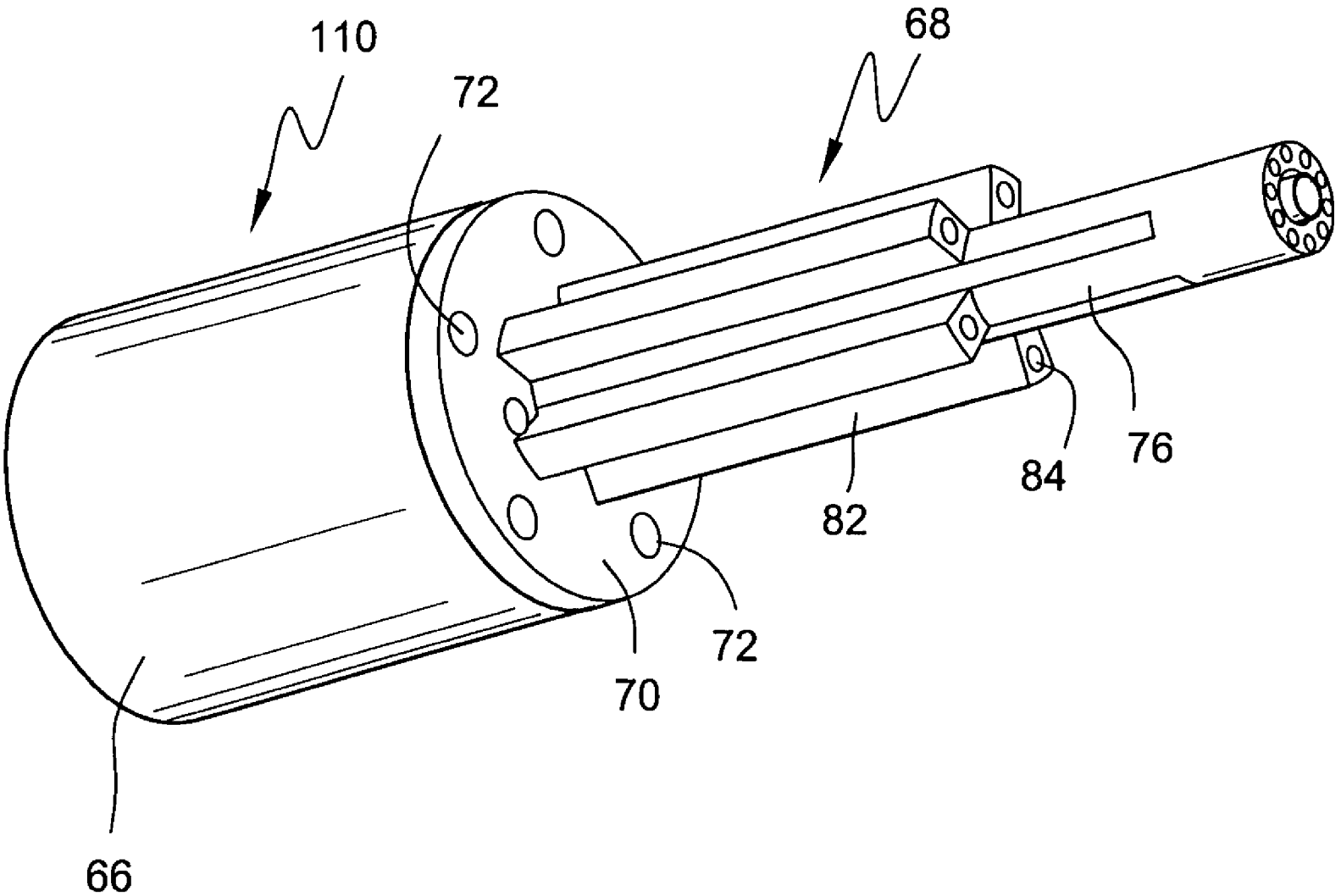
FIG. 5 is a perspective view of the assembled secondary fuel nozzle according to the example embodiment.

Referring to FIGS. 3 and 4, in an example embodiment of the invention, the secondary fuel nozzle assembly 110 is provided as an integrated one-piece assembly formed by brazing and welding a core portion and a unitary secondary fuel nozzle portion. In the illustrated example embodiment, the core portion is comprised of a unitary core member 50 and a cylindrical body section 66 disposed in surrounding relation thereto. Thus, as illustrated, a core 50 is provided that includes a central passage 52 for receiving the current, conventional liquid fuel cartridge 32 and tip (details of the tip being omitted in FIG. 4 for clarity), and a plurality of concentric passages 54, 58 having respective inflow access ports 56, 60. In the illustrated example embodiment first and second concentric passages are shown by way of example. The concentric passages may be machined in the body of the secondary fuel nozzle with a lathe type machining operation. When the liquid fuel cartridge is added, water or air can circulate around the cartridge and liquid fuel can pass through the center just as it does in the conventional assembly. More or less passageways can be provided as needed. In this regard, some secondary fuel nozzles for Gas Only require just two passages.

As illustrated, the radially inner 54 of the two illustrated concentric passages is longer to allow a hole to simply be drilled to provide access port 56 for dual fuel operation. A hole is drilled also for access 62 to the central passage 52, more specifically for access to the space around the liquid fuel cartridge 32 as mentioned above. So that the secondary fuel nozzle assembly 110 can be attached to the combustion end cover (not shown), slots or bores are formed at or adjacent the periphery of the core portion for receiving respective bolts. In the illustrated example, slots 64 are formed in the peripheral surface of the core member 50 for bolt access.

The secondary fuel nozzle assembly further includes a one piece secondary fuel nozzle portion 68. The secondary fuel nozzle portion includes a base flange 70 having a plurality of bores 72 defined therein for respectively aligning with the bolt slots of the core. Port 74 is included for completeness. It is a view port for the flame detector camera and is standardly included on most combustors, to make sure flame is lit and stays lit.

In the illustrated example embodiment, the secondary fuel nozzle portion further includes a main shaft 76 having a central bore 78, for aligning with the central bore 52 of the core 50 and for receiving the liquid fuel cartridge 32, and a plurality of peripheral bores 80 disposed at spaced locations about the central bore 78. The peripheral bores 80 are disposed for flow communication, in the assembled unit, with the radially inner manifold/passage 54 of the core 50.

The unitary secondary fuel nozzle portion further includes a plurality of fins 82 that project from the main shaft 76, each having at least one bore 84 defined axially therethrough, radially outwardly of the plurality of bores 80 of the main shaft 76 and disposed for flow communication, in the assembled unit, with the radially outer manifold/passage 58 of the core 50. In an example embodiment, the bores 80, 84 of the secondary fuel nozzle portion, including the bores of the main shaft and of the fins, are gunned drilled through a solid component.

In an example implementation, liquid fuel goes in central pipe 32. Access 62, central passage 52, and central bore 78, outside pipe 32 are for water or air injection, for cooling the tip. This water or air cooling will spray out with fuel into the combustion chamber. The tip of pipe 32 is shown as solid bar stock for convenience as the tip configuration does not per se comprise the present invention. The tip to be used may be a conventional tip design. For completeness it is noted that passage 58 and aligned holes 84 are for gas fuel, and passage 54 and holes 80 aligned therewith are for transfer gas fuel.

To assemble the secondary fuel nozzle, braze plate 86 is interposed between the distal end face of the core 50 and the base flange 70 of the nozzle portion 68 and then the assembly is heated to fuse the core 50 and base flange 70 together. More specifically, in the illustrated example embodiment, the three concentric parts of the braze plate 86 are applied to the solid cylinder end part 50, then base flange 70 is furnace brazed to core 50 using the three concentric parts. Then cylindrical body section 66 is slid over core 50 and secured to base flange 70 by circular welding around cylindrical body section 66. Consequently, the core 50, cylindrical body section 66, and a one piece secondary fuel nozzle portion 68 are integrated to define the one piece secondary fuel nozzle 110.

According to a further example embodiment, the one piece secondary fuel nozzle 110 may be retrofit to replace a conventional secondary fuel nozzle. In this regard, the current secondary fuel nozzle can be simply unbolted and the new integrated secondary fuel nozzle bolted on in its stead. In this regard, the new, e.g. gun drilled secondary fuel nozzle is advantageously configured to occupy the same basic profile as the current secondary fuel nozzle, but use less parts to manufacture. Further, as indicated above, in production e.g. current tip end parts would be attached by welding or brazing on the end of the new gun drilled secondary fuel nozzle in a conventional manner.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A secondary fuel nozzle assembly comprising:

A core portion having proximal and distal longitudinal ends, a central bore extending therethrough from said proximal end to said distal end for receiving a liquid fuel cartridge, and at least two passages concentric with said central bore and extending axially in parallel to said central bore along at least a part of the length thereof to said distal end; and a unitary secondary fuel nozzle portion, the secondary fuel nozzle portion including a base flange, and a main shaft having a central bore for aligning with the central bore of the core portion and for receiving the liquid fuel cartridge, and a plurality of peripheral, axially extending bores where each bore is disposed at a respective circumferentially spaced location about and extending in parallel to the central bore of the secondary fuel nozzle portion for flow communication at a proximal end thereof with at least one of said concentric passages of the core portion at the distal end of the core portion, wherein said core portion and said one piece secondary fuel nozzle portion are integrated into a one-piece assembly by being at least one of brazed and welded together.

2. A secondary fuel nozzle assembly as in claim 1, wherein said core portion comprises a unitary core member having said central bore and concentric passages and a cylindrical body section in surrounding relation to said core member.

3. A secondary fuel nozzle assembly as in claim 1, wherein a radially inner one of two adjacent said concentric passages is longer than the other so as to extend further than the other towards said proximal end of the core, and wherein an access hole is defined radially to the extended portion of said radially inner concentric passage.

4. A secondary fuel nozzle assembly as in claim 3, wherein said access hole is drilled through said core portion to said radially inner concentric passage.

5. A secondary fuel nozzle assembly as in claim 1, wherein an access hole extends radially from an outer peripheral surface of said core portion to the central bore thereof.

6. A secondary fuel nozzle assembly as in claim 5, wherein said access hole is drilled through said core portion to said central bore.

7. A secondary fuel nozzle assembly as in claim 1, wherein said peripheral bores are formed by gun drilling said unitary secondary fuel nozzle portion.

8. A secondary fuel nozzle assembly as in claim 1, wherein at least one of bores and slots are formed adjacent to or at an outer peripheral surface of the core portion for bolt access for attachment to a combustion end cover, and wherein the base flange has a plurality of holes defined therein for respectively aligning with the bolt bores or slots of the core portion.

9. A secondary fuel nozzle assembly as in claim 1, wherein said secondary fuel nozzle portion includes first and second sets of peripheral bores, for respective flow communication with a first one of said concentric passages and a second one of said concentric passages, said first set of peripheral bores being defined in the main shaft to surround said central bore thereof, and a plurality of fins project from and extend along at least a portion of the length of the main shaft, each said fin having at least one said peripheral bore of said second set defined axially therethrough.

* * * * *